United States Patent [19]

Gregory

[11] Patent Number: 4,914,862

[45] Date of Patent: Apr. 10, 1990

[54] SAFETY DEVICE FOR SASH WINDOWS

[76] Inventor: J. Lee Gregory, 319 Lee Industrial Blvd., Austell, Ga. 30001

[21] Appl. No.: 237,093

[22] Filed: Sep. 22, 1988

[51] Int. Cl.[4] ..... E05D 13/00
[52] U.S. Cl. ..... 49/322; 49/445
[58] Field of Search ..... 49/322, 445, 446, 301; 187/82, 81, 88

[56] References Cited

U.S. PATENT DOCUMENTS 2,095,695 10/1937 Greegor ..... 49/322
3,055,044 9/1962 Dinsmore ..... 49/445

FOREIGN PATENT DOCUMENTS 2833483 2/1980 Fed. Rep. of Germany ..... 49/322

*Primary Examiner*—Kenneth J. Dorner
*Assistant Examiner*—Gerald A. Anderson
*Attorney, Agent, or Firm*—Patrick F. Henry, Sr.

[57] ABSTRACT

A spring loaded safety member is pivotally mounted against a coil spring seated within the channel of a standard pulley and spring system which has been moved slightly in the channel. The safety member comprises sharp teeth and is normally retracted in the channel with a curved portion around a pin extending laterally therethrough. Upon failure of the cord or spring of the standard window system the safety member suddenly pivots outwardly under spring pressure to engage the inner wall of the window frame.

6 Claims, 1 Drawing Sheet

SAFETY DEVICE FOR SASH WINDOWS

The field of the invention is window devices and particularly sash windows which employ spring and pulley systems that provide the tension to hold the window in place by means of a cord or cable which is attached to the fixed window sash. The present invention provides a safety member which is automatically sprung into place upon failure of the spring or cable.

There is a standard window installation having the usual window casing, window sash and window mullion arrangement in which the sash balance system comprises a channel having a movable sash balanced by means of a coil spring within the channel having one end attached to the channel and the other end attached to a compound pulley system utilizing a cable or cord which is attached to the window frame whereby the spring is expanded and contracted by movement of the pulley system as the sash is moved upwardly and downwardly. It is not unusual for cords or springs to break and the sash to fall sometimes on the operator's fingers causing severe injury. There is no way to prevent the window sash from moving when the cord or spring breaks. There is a real need for some sort of safety device which is activated automatically when the cord or spring breaks. The present invention provides such a safety device in the form of a pivotally mounted three dimensional member which has sharp teeth that will dig into the edge of the window frame with great force provided by a loaded coil spring.

An object of this invention is to provide a safety device that is automatically operated upon failure of the sash cord or spring of a pulley system installed with the sash window.

Another object of this invention is to provide a three dimensional safety member which is spring biased and spring loaded in retracted condition so that it rapidly springs outwardly to bring serrated edges quickly into engagement with the edge of window frame.

An additional object of the present invention resides in the simplicity and economy of the construction, installation and operation whereby the device may be installed on all existing or new installations which employ spring and pulley systems.

Still another object of the present invention resides in the ease of deactivating the device once it has been activated into operation.

Other and further objects and advantages of this invention will become apparent upon reading the following description of a preferred embodiment taken in conjunction with the accompanying drawings, in which.

DESCRIPTION OF A PREFERRED EMBODIMENT

Figure 1:
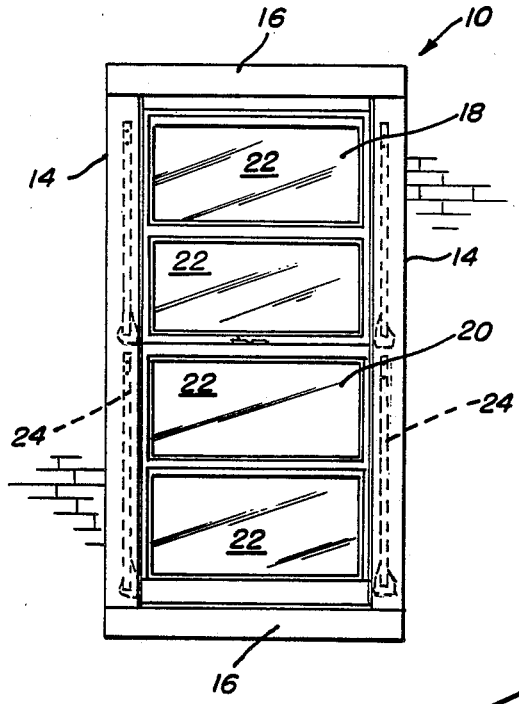
FIG. 1 is a front elevation view of a standard double hung window of the type in which the present device will be installed.
Figure 2:
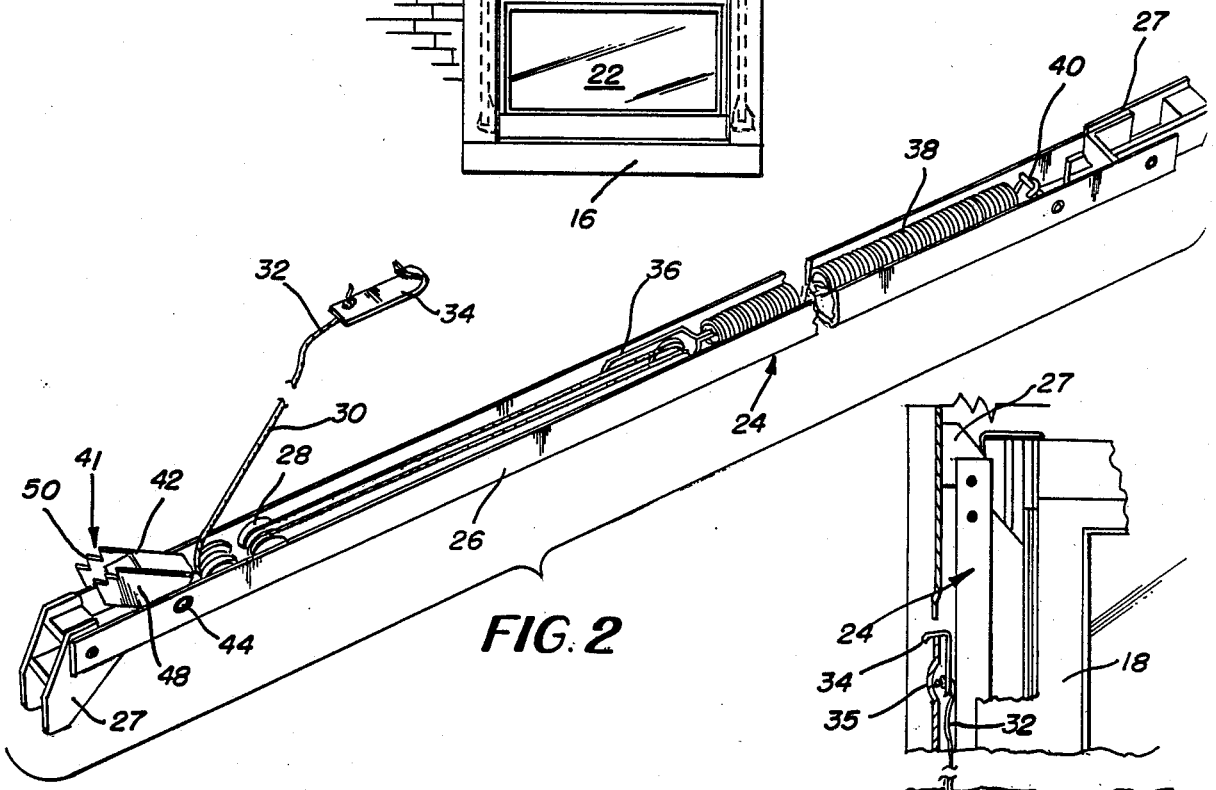
FIG. 2 is a perspective view of one of the sash balances with the present device installed in place of the standard roller mounting which has been moved in the channel or track to accommodate the present safety device. The safety device in this figure is not under tension and has been sprung out of the channel into its locking or breaking mode which would occur upon breaking of the cord.

A standard double hung window arrangement 10 comprises a wood or metal window frame 12 having opposed side frame members 14 and top frame members 16 constructed into a frame arrangement installed into an opening in a wall. The window frame accommodates two window sashes 18 and 20 having glass panels 22 therein. Window sashes 18 and 20 are supported for vertical operation upwardly and downwardly in the frame 12 with a side track or channel 24 having a back side 26 placed against the side of the window. Channel 24 has end brackets 27 and is attached in place on the window to move therewith.

Figure 3:
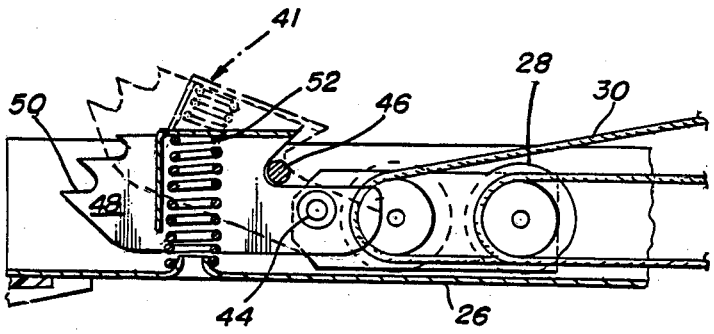
FIG. 3 is a side elevation view in section of the present safety device having the standard pulleys under tension and the safety member pulled back into the track into retracted position out of contact with the casing jam and showing the safety member in phantom lines as would appear when the cord or spring breaks.
Figure 4:
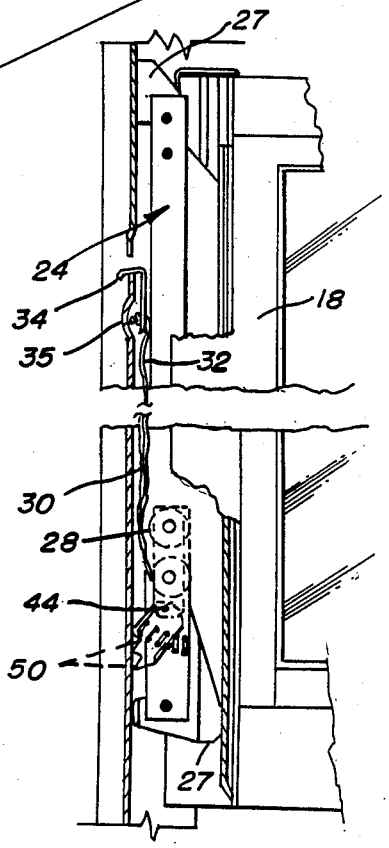
FIG. 4 is a partial section view of the typical window sash showing the cam sash and the sash balance installed with the present safety device which is shown in position as it would appear when the spring or cord are broken and the device digs into the jam.

Located within the channel 24 is a conventional, standard window pulley arrangement comprising pulleys 28 arranged in a compound pulley system having a cord or cable 30 installed around the pulleys 28 with a terminal end 32 attached by a clip 34 to the inside of the casing jam 35. The pulley 28 is attached by bracket 36 to a coil spring 38 which has an end 40 attached to the top part of the channel 24 so that operation of the window sash 18 or 20 extends or retracts the coil spring to balance the weight of the window and assist in the upwardly and downwardly movement thereof. The previous description is of a standard or conventional window system. In the bottom part of channel 24 the space has been created to receive the window safety device 41 having a safety member 42 which is pivotally mounted on a transverse pivot rod 44 in channel 24 for movement around a transverse fulcrum pin 46 transversely mounted across the inside of channel 24. Window safety member 42 is three dimensional in shape with spaced sides 48 forming an open interior channel and each side 48 has teeth 50 thereon which dig into the window jam. The member 42 is normally retracted into the channel 26 in the position of the full lines in FIG. 3 against a coil spring 52 by the force of the pulley 28 system and the coil spring 38 against the fulcrum point on the pin 46 but upon releasing or relaxing of the proper amount of tension on the pulley cord 30, such as when the cord 30 breaks or the spring 38 breaks or the pulleys 28 break or pin 40 breaks, the tension which holds the safety member 42 in retracted position is released and the safety member 42 immediately and forceably springs into an outward position shown in FIG. 4 with the teeth 50 engaged in the window jam. Accordingly, if an operator is lifting or lowering the window sash 18, 20 and the cord 30 breaks, the safety device 42 springs into action immediately and stops the fall of the sash 18 or 20 and prevents injury to the operator. If the window 10 is being raised, the safety device 41 does not restrict it should the cord 30 break or other defect occur, but it will activate automatically to prevent the sash 18 or 20 from falling when the lifting force is removed. The re-positioning and deactivation of the safety member 42 is simply a matter of correcting the problem, such as the broken cord 30 or the broken spring 38, and then re-establishing the proper tension on the pulley 28 system whereby the safety device 42 is retracted into its normal position shown in FIG. 3.

While I have shown and described a particular embodiment of my invention for purpose of illustration this is not the only form of the invention since there are various changes, alterations, deviations, and departures which may be made in the preferred embodiment without avoiding the scope of this invention as set forth only by a proper interpretation of the appended claims.

what is claimed:

1. In a window system comprising an upwardly and downwardly movable window sash supported in a window frame and jam in which there is installed a window tension system, the improvement comprising: a safety member normally retracted by the tension in said window tension system from engagement with the window jam during normal operation of the window sash but being operable into position upon the abnormal relaxation of tension in the tension system which would occur when the tension is abnormally relaxed as when the tension system breaks or malfunctions, thereby preventing said sash from falling free, said safety member having a portion thereof for engagement with part of the window frame, means for movably supporting said safety member, and spring means operable to move said safety member, said safety member being pivotally mounted on said window sash and a fulcrum member on said window sash having said safety member engaged for operation there against.

2. The device of claim 1 wherein said safety member comprises an open back channel and said spring means is a coil spring positioned in said open back channel to operate said safety member.

3. The device in claim 1 wherein said safety member has a recessed portion thereof against said fulcrum member for movement thereabout.

4. The device of claim 1 wherein said portion comprises teeth.

5. The device in claim 1, wherein said tension system comprises a spring and pulley system on said sash and means connecting said spring and pulley system to the window jam.

6. The device in claim 5 wherein said connecting means comprises a flexible connecting member.

* * * * *